US005745029A

United States Patent [19]

Garcia

[11] Patent Number: 5,745,029

[45] Date of Patent: Apr. 28, 1998

[54] REFEREEING AID SYSTEM FOR BALL GAMES

[75] Inventor: Manuel Garcia, 11 rue Pablo Neruda, 17700 Surgeres, France

[73] Assignee: Manuel Garcia, Surceres, France

[21] Appl. No.: 392,914

[22] PCT Filed: Sep. 3, 1993

[86] PCT No.: PCT/FR93/00840

§ 371 Date: Mar. 3, 1995

§ 102(e) Date: Mar. 3, 1995

[87] PCT Pub. No.: WO94/05380

PCT Pub. Date: Mar. 17, 1994

[30] Foreign Application Priority Data

Sep. 3, 1992 [FR] France ..... 92 10537

[51] Int. Cl.[6] ..... G08B 23/00

[52] U.S. Cl. ..... 340/323 R; 340/539; 340/691; 273/433; 273/435; 273/439; 364/410; 364/411

[58] Field of Search ..... 340/531, 539, 340/691, 692, 323 R; 273/433, 434, 435, 439; 364/410, 411

[56] References Cited

U.S. PATENT DOCUMENTS

| | | | |
|---|---|---|---|
| 5,083,271 | 1/1992 | Thacher et al. | 364/411 |
| 5,109,228 | 4/1992 | Banaszak | 341/175 |
| 5,283,733 | 2/1994 | Colley | 365/411 |

*Primary Examiner*—Jeffrey Hofsass
*Assistant Examiner*—Daryl C. Pope
*Attorney, Agent, or Firm*—Bacon & Thomas

[57] ABSTRACT

A refereeing aid system for ball games in which refereeing is performed by a referee in charge together with at least one auxiliary judge, both present on the playing field, includes a communications device held by the referee enabling refereeing data to be input and communicated to a management device disposed in the vicinity of the playing field and connected to a central computer which centralizes data from a plurality of management devices present at different playing fields. The management device also include an input for confidential personal data relating to each participant in the game.

12 Claims, 5 Drawing Sheets

FIG. 2
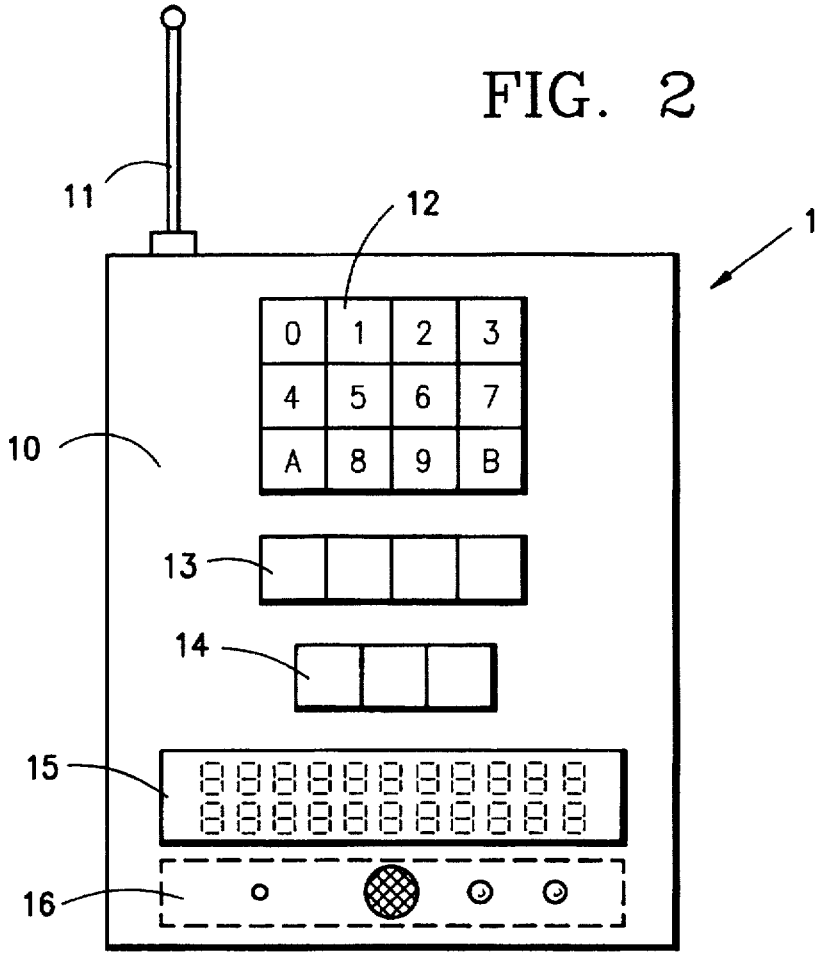
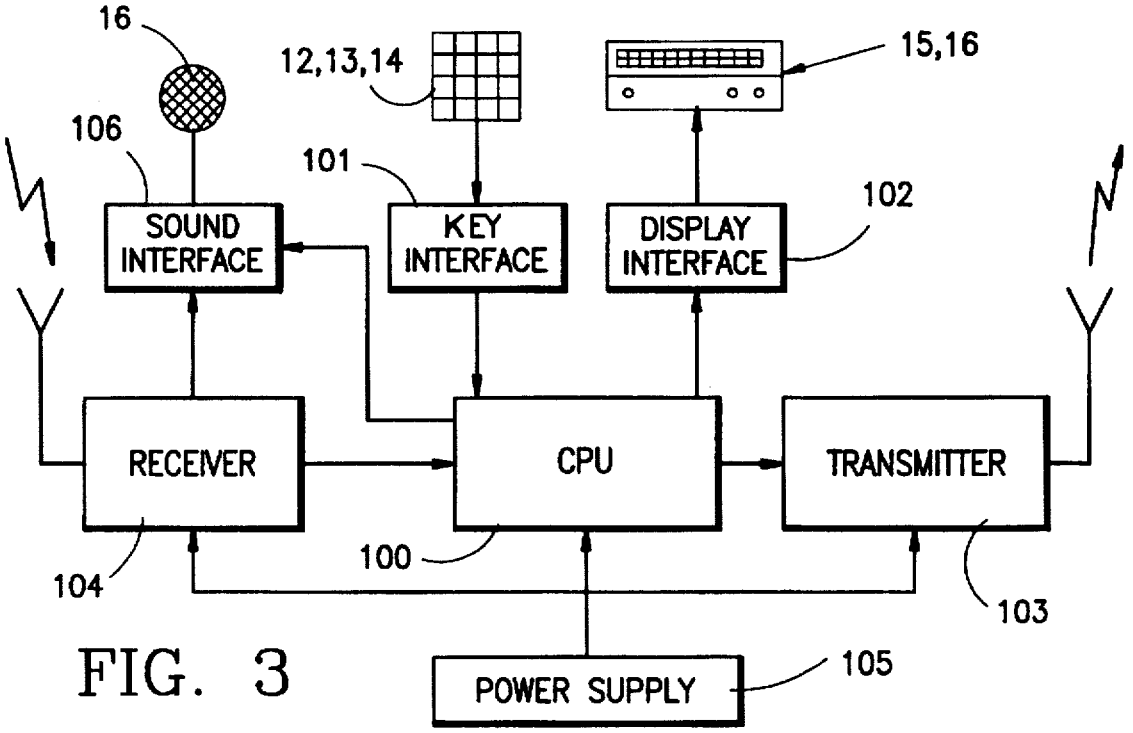
FIG. 3

REFEREEING AID SYSTEM FOR BALL GAMES

BACKGROUND OF THE INVENTION

1. Field of the Invention

The present invention relates to a refereeing aid system for ball games that are judged by a person in charge [referred to herein as the "referee", regardless of the particular terminology, e.g. "umpire", that may be conventional) for the game concerned] with assistance from auxiliary judges.

2. Description of Related Art

At present, in team games, as in numerous individual sports, refereeing is performed by individuals who are present on the playing field and who must, throughout the duration of the match, be fully aware of what the various protagonists are doing on the field. This requires a level of vigilance at all times that it is often difficult to achieve, particularly during fast action sequences of the game. This gives rise to refereeing errors which can be most prejudicial to the parties concerned, and indeed sometimes to the referee himself.

An approach to the solution is given in patent application DE 3 120 584 which discloses a signalling system intended mainly for football [i.e. soccer] referees and including firstly a transmitter placed in the flag of each of the linesmen and secondly a receiver made available to the referee. Pressing a pushbutton on the linesmen's flag causes the referee's receiver to emit a sound signal, so the referee can interrupt the game and go and speak with the calling linesmen.

Nevertheless, that solution is not entirely satisfactory since firstly it does not locate the caller and secondly it does not enable the referee to find out quickly the reason for the call and therefore decide whether or not to continue the game. In addition, such a system does nothing to solve other refereeing problems due to human error or even dishonest maneuvers by certain people on or around the playing field.

SUMMARY OF THE INVENTION

Thus, an object of the present invention is to mitigate the above drawbacks and to propose a refereeing aid system that makes refereeing fairer and more reliable by keeping the referee rapidly informed about actions of the game that may be taking place outside his field of view, and also enabling him to input and to access refereeing data necessary for running the match.

Another object of the invention is to transmit information collected by the referee during a match to a computer terminal for handling the data, tabulating it, and reproducing the tabulated data for use as soon as the match is over.

These objects are achieved by a refereeing aid system for ball games, the system comprising communications means held by the referee and provided with transmitter means enabling refereeing data previously input via input means to be communicated to management means disposed close to the playing field and connected to computer means that centralize refereeing data coming from a plurality of management means present at different playing fields.

The input means enable the referee to note down throughout the match numerous kinds of information necessary for refereeing purposes (e.g. goals, sendings off of players, other punishments, . . . ).

Because the referee has transmitter means, it is possible within minutes from the end of a match to forward all of the data relating to the match, and in particular the results or any punishments handed out to such or such a player. It is then possible, on the basis of this data and of data coming from other playing fields to draw up league tables very quickly and at several levels: local, regional, national, or even international.

The input means made available to the referee include a first set of keys comprising alphanumeric keys for inputting coordinates of the participants, a second set of keys comprising symbol keys for inputting parameters specific to the game in question, a third set of keys comprising function keys and including, in particular, an "enter" key for confirming preceding inputs, and a set of indicator means for verifying operations performed and for giving information to the referee.

Advantageously, the set of indicator means comprises a luminous display and a series of audible and visible indicator means.

Each auxiliary judge's transmitter means includes a voice transmission circuit to enable the auxiliary judge to speak with the referee and thus avoid the referee making wasted journeys and enabling him to decide at once whether or not the action of the game is to continue.

The presence of an encoding circuit in these transmitter means also enables the referee to identify automatically which auxiliary judge is calling, which is found to be essential in games that have a large number of auxiliary referees (e.g. American football).

The management means comprise computer means, input means, display means, transmitter/receiver means, and means for inputting confidential data to receive personal information relating to each participant in the game.

The confidential data input means make it possible to check on the participants, each of whom must possess a portable device including an integrated circuit memory that is compatible with said input means, which memory makes available all of the information that applies to each participant.

The management means may also include printer means for use at the end of a match to issue information relating to the actions that took place on the playing field.

Similarly, it is advantageous for the management means to include remote display means enabling the public to follow certain decisions of the referee more closely (e.g. the issuing of a yellow card during a football match).

The transmitter means include a transmitter circuit whose coded transmission is controlled by a switch itself controlled directly by the judge or indirectly by the fact that the judge is holding up a flag in his possession.

BRIEF DESCRIPTION OF THE DRAWINGS

Other characteristics and advantages of the present invention appear more clearly on reading the following description given by way of non-limiting indication and made with reference to the accompanying drawings, in which:

FIG. 2 shows an embodiment of a referee module;

FIG. 3 is a block diagram showing the architecture of the FIG. 2 referee module;

DETAILED DESCRIPTION OF THE PREFERRED EMBODIMENTS

Figure 1:
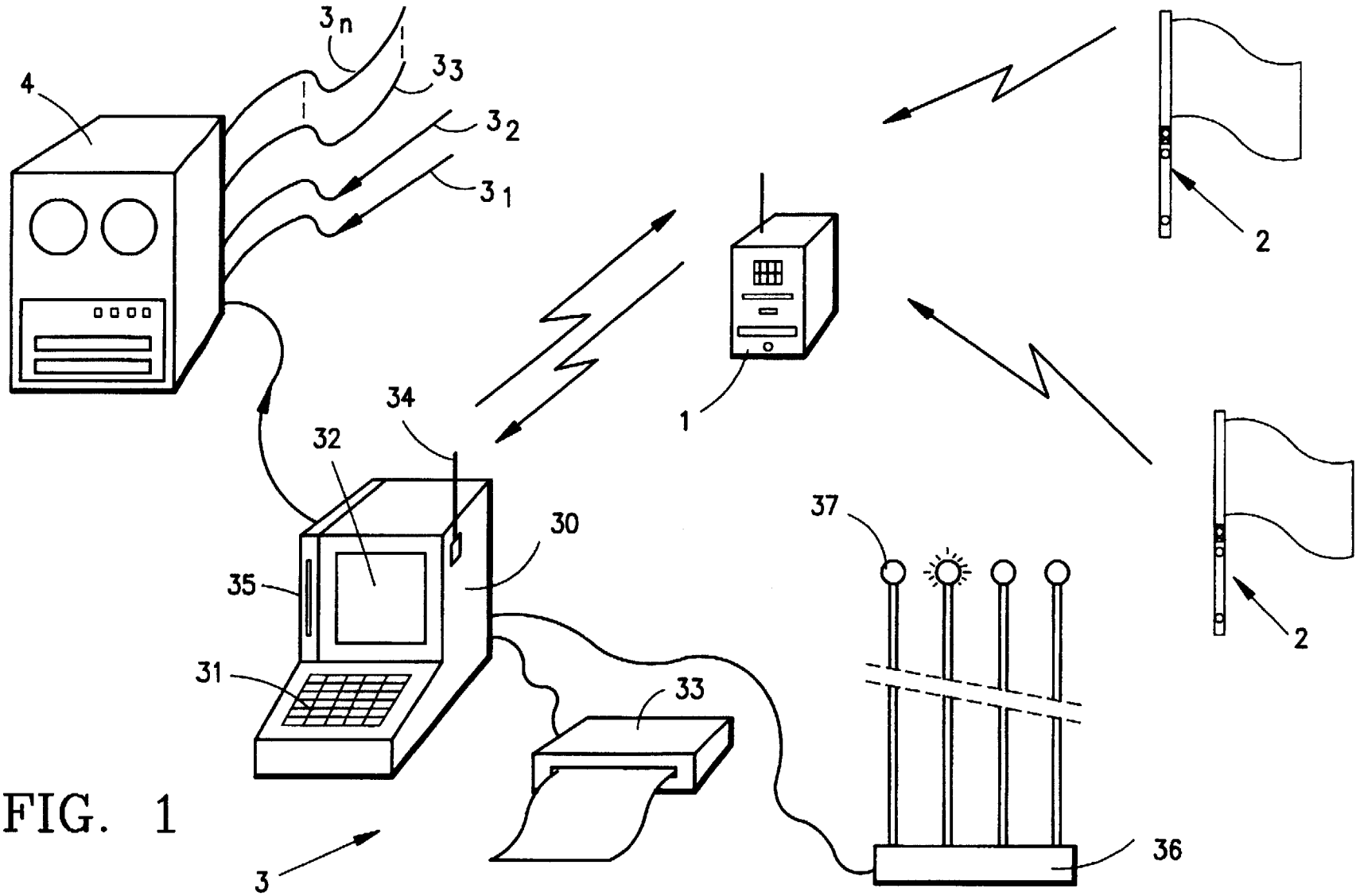
FIG. 1 is a simplified diagram showing the various links that exist between the various component elements of the refereeing system of the invention.

FIG. 1 shows in simplified manner the various elements constituting the refereeing aid system of the invention together with the links between said elements. The system comprises a referee module 1 comprising a communications set (receiver/retransmitter) that receives radio transmissions coming from the transmitters of the auxiliary judge 2 and for sending reports to a management terminal 3 which is connected to a central computer 4, e.g. over the switched telephone network. In conventional manner, the management terminal 3 has computer means 30, input means 31, display means 32, and printer means 33. It also includes transmitter/receiver means 34, confidential data input means 35, and remote display means 36.

The display means 32 are preferably also capable of performing certain input functions, said means being present in the form of a touch-sensitive screen. This terminal based beside the playing field communicates via a radio link with the referee module 1 that is held in the hand of the referee in charge of the match. Each of the referee's assistants on the field possesses an auxiliary judge's transmitter 2 which they can activate to get the attention of the referee and to be heard by him. Because of this system, the referee is immediately informed of all of the actions undertaken by his assistants, thereby ensuring that his own decisions are not invalidated by an earlier decision of an auxiliary judge that the referee has not been able to see or hear. The presence of input means on the referee module 1 also serves to enable the referee to mark the various stages of the game and to make a note of incidents that occur during the match. This information is instantly transmitted to the management terminal 3 which can process it, i.e. sort it and then tabulate it to facilitate interpretation and use thereof by the parties concerned after the match. In addition, some of the information may be displayed via the remote display means so as to convey it to the public present at the match.

Thus, for example, when used with football, the referee will signal goals, fouls, injuries, or indeed punishments to the terminal 3 via the portable module 1. The signalled information may be made available to the public by the remote display means which may be constituted, for example, by a set of bright lights 37 visible to everyone. Thus, provision may be made to shine a yellow light for a determined length of time when the referee issues a yellow card to a player. The terminal given this data is then in a position to issue a match sheet which the referee will confirm before it is printed out on the printer means 33 and sent to the central computer 4 over the switched public network or over any other telecommunications means. The central computer is also connected to management terminals $3_1$ to $3_n$ available at other playing fields and serves to collate all of the data, thus making it possible to keep up-to-date on a local, regional, or national level depending on the processing being performed. Naturally this central computer need not be a single computer but could, on the contrary, be constituted by a hierarchical network of computers going from a local computer that collates information from a plurality of playing fields to a supercomputer acting at national or even international level and collating all of the information available, e.g. for the purpose of broadcasting it via broadcasting services.

It should be observed that the match sheet which is updated throughout the match via successive communications from the referee module 1 needs to be headed with a certain amount of essential information about the players, e.g. their family names, forenames, and shirt numbers, about the directors, and about the judges, in particular. This information is input at the beginning of the match by the referee using the input means 31 or else it is merely downloaded previously, with the information then being confirmed immediately before the match in the presence of the captains of the two teams. At that moment, it is also necessary to call over the players who are actually to play in the match. This is done by the confidential data input means 35 with each player inserting a personal IC card that stores an identity photograph in digital form, possibly in compressed form.

FIG. 2 shows a preferred embodiment of the referee module 1. The module 1 comprises a housing 10 fitted with a transmitter/receiver set 11 and having several sets of keys or indicator means on its front face: a first set of keys 12 that are alphanumeric for inputting the coordinates of various players (e.g., in the context of an application to football, the sweeper of the visiting team is referenced B7); a second set of keys 13 comprises symbol keys for inputting parameters characteristic of the game in question (e.g. in an application to rugby football, one key will mean "drop goal", another "try", another "injury", etc. . . . ); a third set of keys 14 comprises function keys including, for example, orders starting and stopping play, or indeed confirming data input; a first series of indicator means 15 advantageously implemented in the form of a luminous liquid crystal display serves to monitor operations performed and to display input or transmission errors; and a second series of indicator means 16 that are visible or audible to warn the referee that an auxiliary judge's transmitter 2 is transmitting or to indicate that data is being transferred between the referee's transmitter and the management means.

Advantageously, the second series of indicator means 16 comprises a loudspeaker or a buzzer, and also light emitting diodes (LEDs) corresponding to each transmitter 2 and to data transfer. The loudspeaker enables the referee to listen to the comments made by an auxiliary judge concerning an incident in the game. It may also emit a different sound for each of the transmitters so as to facilitate respective identification thereof.

The luminous display 15 preferably comprises two lines of 16 characters each, but clearly it is not limited to that particular configuration.

The housing 10 is generally rectangular in shape and miniaturized as much as possible, however it must be large enough to receive the transmitter/receiver set which may be of low power, about 5 mW, while nevertheless being powerful enough to ensure that the module has a range of not less than 100 meters (m).

Operation of the referee module is described below with reference to FIG. 3 which shows its hardware architecture.

The module is organized around a microprocessor 100 and its associated memories (not shown) with interfaces 101 and 102 being connected thereto respectively for the various sets of keys 12, 13, 14 and the displays 15, 16, transmitter and receiver circuits 103 and 104 for the links with the auxiliary judge's transmitters 2 and with the management terminal 3, and a sound interface circuit 106 for relaying to the loudspeaker speech from an auxiliary judge. A power supply circuit 105 powers all of the circuits (advantageously from a battery).

When an auxiliary judge signals a foul (e.g. off-side in a team ball game) the buzzer and the LED relating to the judge in question are actuated (the LED may be actuated to shine continuously or to flash), serving to provide rapid visual identification of the calling judge. The auxiliary judge can then inform the referee about the incident enabling the referee to take the appropriate decision for the game, e.g. issuing a yellow card to the player who has fouled. The referee then needs to key in the number of the player via the first set of keys 12, optionally confirm it via the third set of keys 14 (the referee can check the input from the display 15), and then enter the selected punishment (yellow card) via the second set of keys 13, followed by further confirmation.

Alternatively only the second confirmation need be performed.

It can happen that the referee makes a mistake and issues a yellow card to a player who has already been punished by receiving a yellow card (which is against the rules). This situation which happens quite frequently in practice is impossible using the refereeing aid system of the invention. Under such circumstances, after confirmation, the buzzer is actuated and the display 15 states that a yellow card has already been given to the player concerned. The referee can then start over, inputting the regulation red card. Advantageously, provision may be made for the necessary change to be made by the microprocessor 100 and displayed on the display 15, leaving it to the referee, merely to press the "enter"key to confirm the verdict of the computer.

Clearly the above principles applying to a "yellow card" are transposable to any other rules for team games or individual sports that require a referee in charge and at least one auxiliary judge providing assistance.

Once the correction has been made, the information can be transmitted by the transmitter 103 to the management terminal 3 for entering into the match sheet which will be provided to each team and to the referee after the match. The transmission can be marked visually by means of the series of indicator devices 16.

The radio signal conveying this information comprises a frame made up of a plurality of bits that are used to identify the type of transmitter (referee module or auxiliary judge module), the number of the transmitter (a plurality of referee modules may be associated with a single management terminal, e.g. in the event of a competition or a tournament), the player's number and team number, and the code representative of the symbol key actuated.

Other bits may optionally also be used for transmitting any other information that appears appropriate in the context of a given sport.

The modulation is preferably on/off amplitude modulation.

Figure 4:
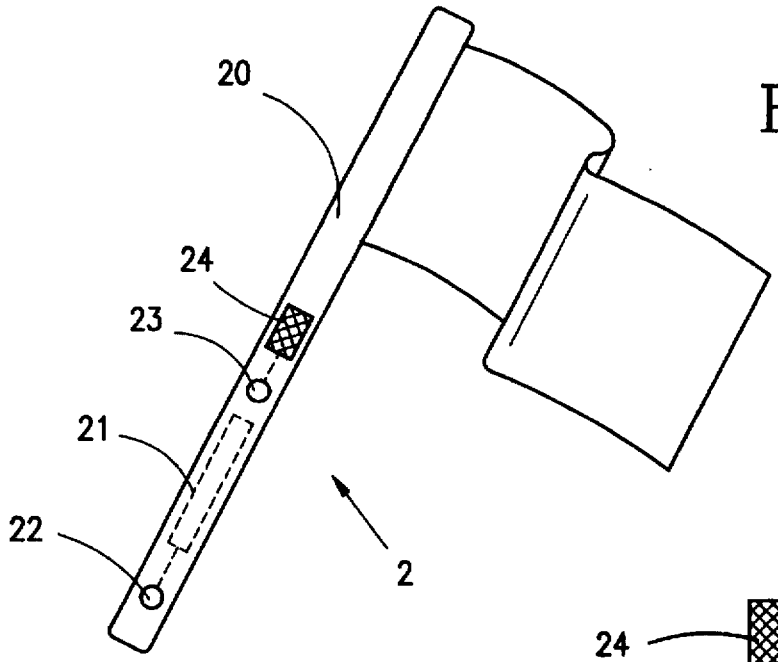
FIG. 4 shows an embodiment of an auxiliary judge's transmitter.

FIG. 4 shows an embodiment of an auxiliary judge's transmitter 2. This is in the form of a flag 20 whose handle contains firstly a transmitter circuit 21 controlled by a first switch 22 and secondly a microphone 24 controlled by a second switch 23.

The switch 22 may be constituted by a simple pushbutton, thereby requiring voluntary activation by the auxiliary judge, or it may be implemented in the form of a mercury switch that is activated each time the flag is held up vertically. It should be observed that this particular flag structure for the transmitter is optional and the transmitter could merely be constituted by a portable housing provided with a manually-operated switch. The microphone 24 and the second switch 23 are of conventional design.

Figure 5:
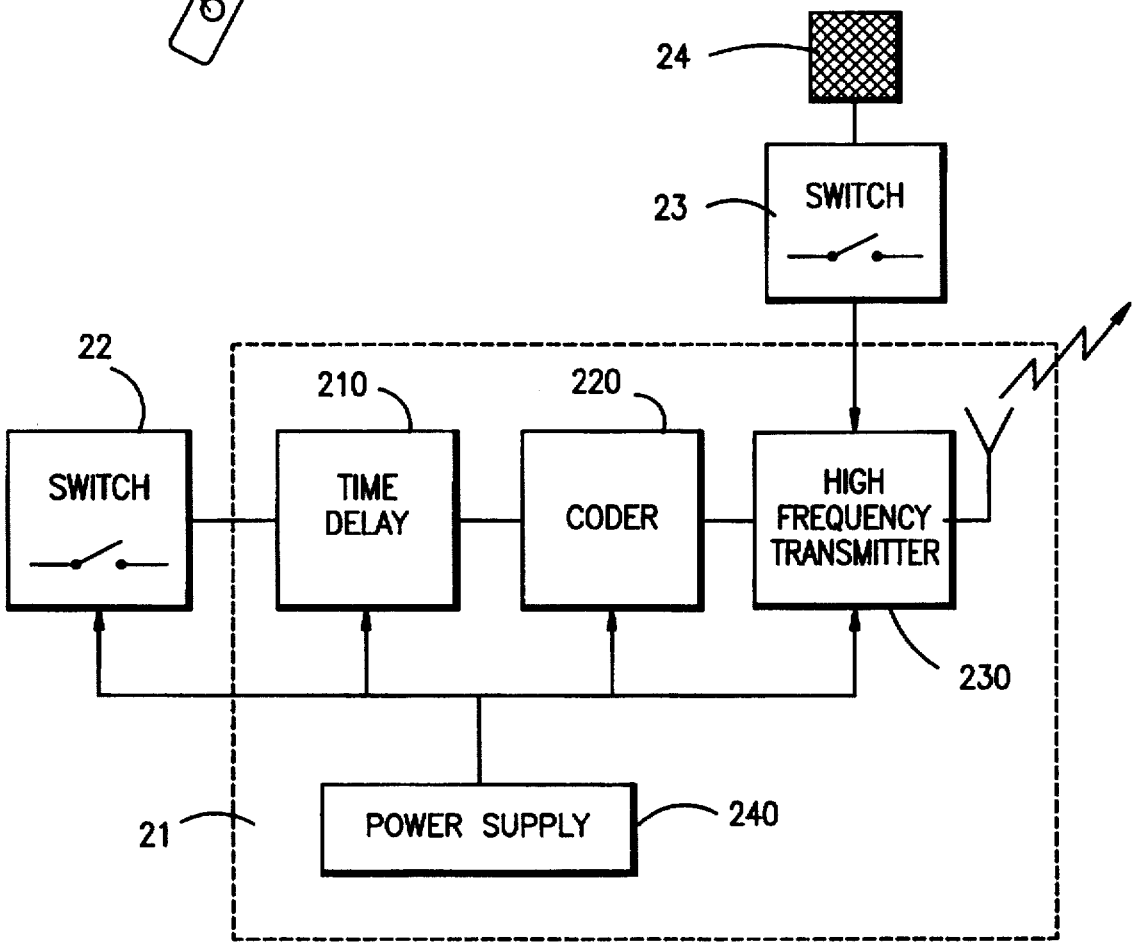
FIG. 5 is a block diagram of the architecture of the FIG. 4 auxiliary judge's transmitter.

The operation of the transmitter 2 is described below with reference to FIG. 5.

After the first switch 22 has been closed, there is a time delay 210 in order to prevent any involuntary transmission of data to the referee module 1, then there is a coding circuit 220 that generates a radio frame for sending to said module via a high frequency transmitter 230. The power supply for these various circuits is based on a battery 240. The high frequency transmission circuit is advantageously identical to that present in the referee module 1, with modulation likewise being of the on/off amplitude type. The frame of bits conveyed from the auxiliary judge's transmitter to the referee module includes at least bits for identifying the calling judge and for designating the transmitter number in order to enable two or more matches to be played simultaneously within the same radio coverage, i.e. using a single management terminal 3. Start and end of transmission bits may also be provided.

Voice messages from the auxiliary judge are transmitted directly via the high frequency transmitter 230 without any prior coding, but only when the second switch 23 is activated.

Figure 6:
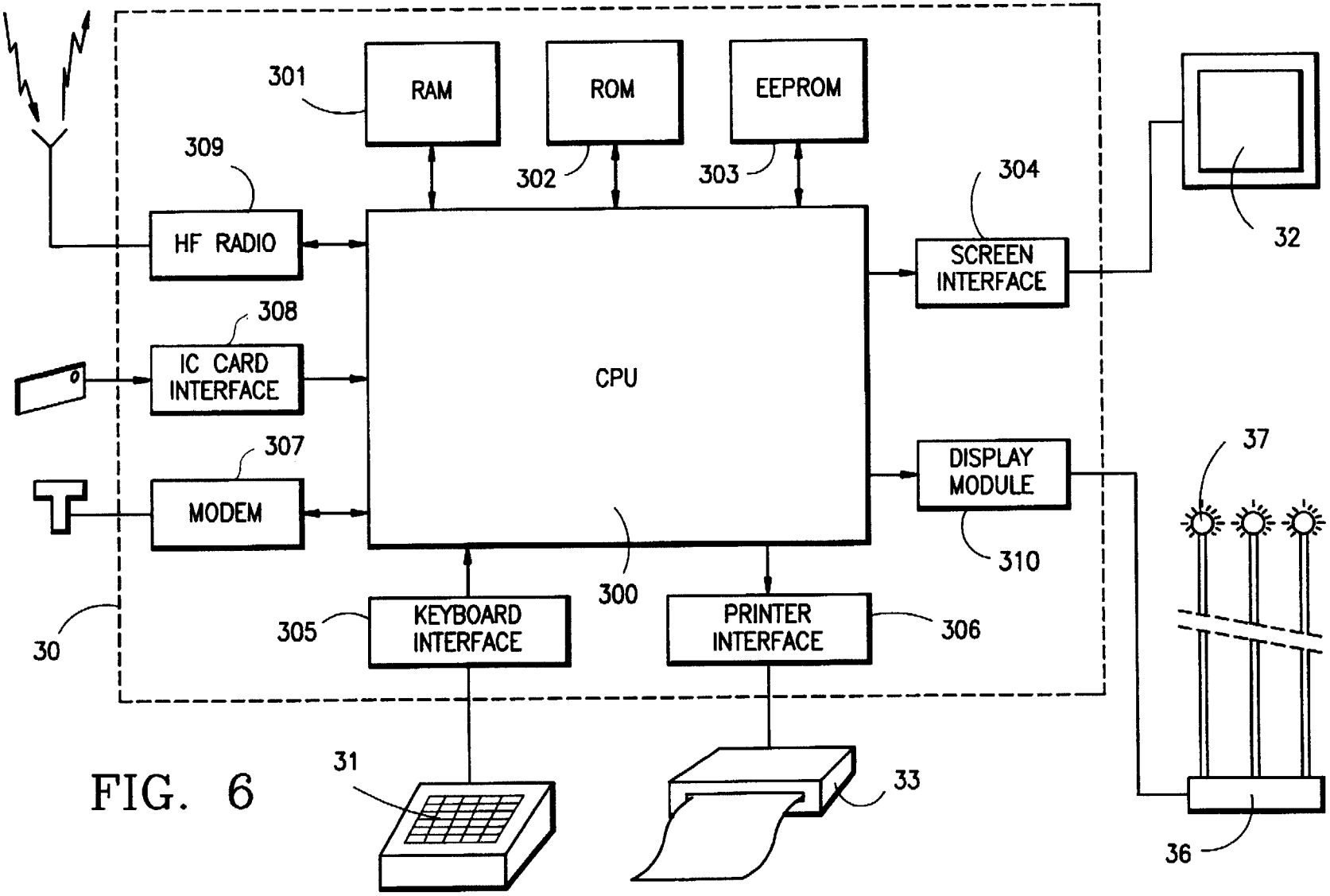
FIG. 6 shows the hardware architecture of the management terminal implemented in the context of the present invention.

FIG. 6 shows the internal structure of the management terminal 3. In conventional manner it comprises a computer unit 300 having connected thereto read/write memory (RAM) 301, non-volatile memory (ROM) 302, and electrically erasable memory (EEPROM) 303, together with a screen interface 304, a keyboard interface 305, a printer interface 306, and a switched telephone network interface (MODEM) 307.

The terminal 3 is also provided with an interface 308 for controlling an integrated circuit card reader set, a radio unit 309, and a display module 310 for controlling the remote display means.

It should nevertheless be observed that since the screen 32 is a touch-sensitive type graphics screen, its interface 304 should be designed accordingly.

The IC card reader set 35 enables confidential data to be input into the terminal as required for confirming the information transmitted to the central computer 4. This data comprises, in particular, information about each player of the kind that appears in his player's license. All of this personal information is stored in an IC memory card, e.g. in credit card format, which card is the property of each player and is used as a professional identity card. Advantageously, additional personal information about each player, such as numbers of goals, tries, or points scored, fouls, or any other relevant data could also be stored in the card. It should be observed that the card should also include a digitized photograph of the player to enable the player to be identified.

The radio unit 309 has a high frequency receiver to decode radio frames coming from the referee module 1 each time the referee transmits. The information extracted therefrom is subsequently stored in the read/write memory 301 and is subsequently available for printing via the printer interface 306 or for transmission to the central computer 4 via the modem interface 307. Some of the information can be made available to the public via the display module 310 which controls the remote display means 36. However, it should be observed that this command may equally well be issued from the radio unit 309. It should also be observed that the remote display could be constituted by a giant panel of lights.

The way in which interchanges between the various elements of the refereeing aid system of the invention are synchronized is described with reference to FIGS. 7*a* and 7*b*.

In order to show more clearly the way in which operations performed in the system run in parallel, operations performed by the auxiliary judge's transmitter (operations 500*a* and 600*a*), by the referee (500*b* and 600*b*), and by the management terminal (operations 500*c*) are all described simultaneously. For exposition purposes, it is assumed that the first action in the game is a foul signalled by an auxiliary judge who raises his flag in a step 501 (account is not taken here of the actions performed by the referee when starting the game, in particular entering the kickoff by pressing one of the function keys 14, and voice communication between the referee and the auxiliary judges is dealt with separately below).

At step 502, the code of the calling judge is transmitted to the referee module 1 and is received by said module in step 503.

If reception takes place properly (step 504), the audible and visible indicator means 16 are actuated at step 505, and at step 506 this call from the auxiliary judge is displayed on the display 15. The referee can then take this information into account and confirm it in a step 507, thereby switching off the indicator means and, in a step 508, causing an acknowledgment to be sent for the auxiliary judge's transmitter that previously made the call. On receiving this acknowledgment in a step 509, the auxiliary judge's transmitter becomes available again for making a new transmission (answer "yes" to step 509).

On the contrary, if the radio frame from the calling judge is not properly received (answer "no " at step 504), then the error is displayed at step 510 on the luminous display 15, and then the error is processed in step 511, i.e. a request is issued for the frame to be retransmitted.

In the absence of any action by the auxiliary judge (answer "no" in step 512), the program that resides in the referee module 1 waits for the referee to act on the keyboard in step 512. The action in question consists in actuating one or more keys in the first set 12 and they are displayed on the display 15 in step 513. If the display is correct, action on an "enter" key in the third set of keys 14 during a step 514 serves to move on to a step 515 in which the items that have been input are verified, i.e. the referee checks that the data as input is valid. (whereas a "no" answer in step 514 causes the system to return to step 512 for new input from the referee).

If the action as input is impossible (in football giving a second yellow card to the same player), this is indicated on the display 15 and a new solution may be suggested to the referee or else he may provide further input in step 511.

Otherwise, a corresponding radio frame is sent to the management terminal in step 517, and then a time out in step 518 serves to wait for a report from the terminal, with absence of any report giving rise to a new transmission. When the frame is received at the management terminal in step 519, the validity of the transmission is verified with retransmission optionally being requested, after which the data extracted from the frame is archived in memory in step 520, and then an acknowledgment is issued in step 521 for the referee module which, on receiving the acknowledgment, is then free to close this input procedure (answer "yes " in step 522) and is ready to begin a new waiting loop (answers "no" in steps 503 and 512) for further actions from the referee or from the auxiliary judges.

Figures 7A, 7B:
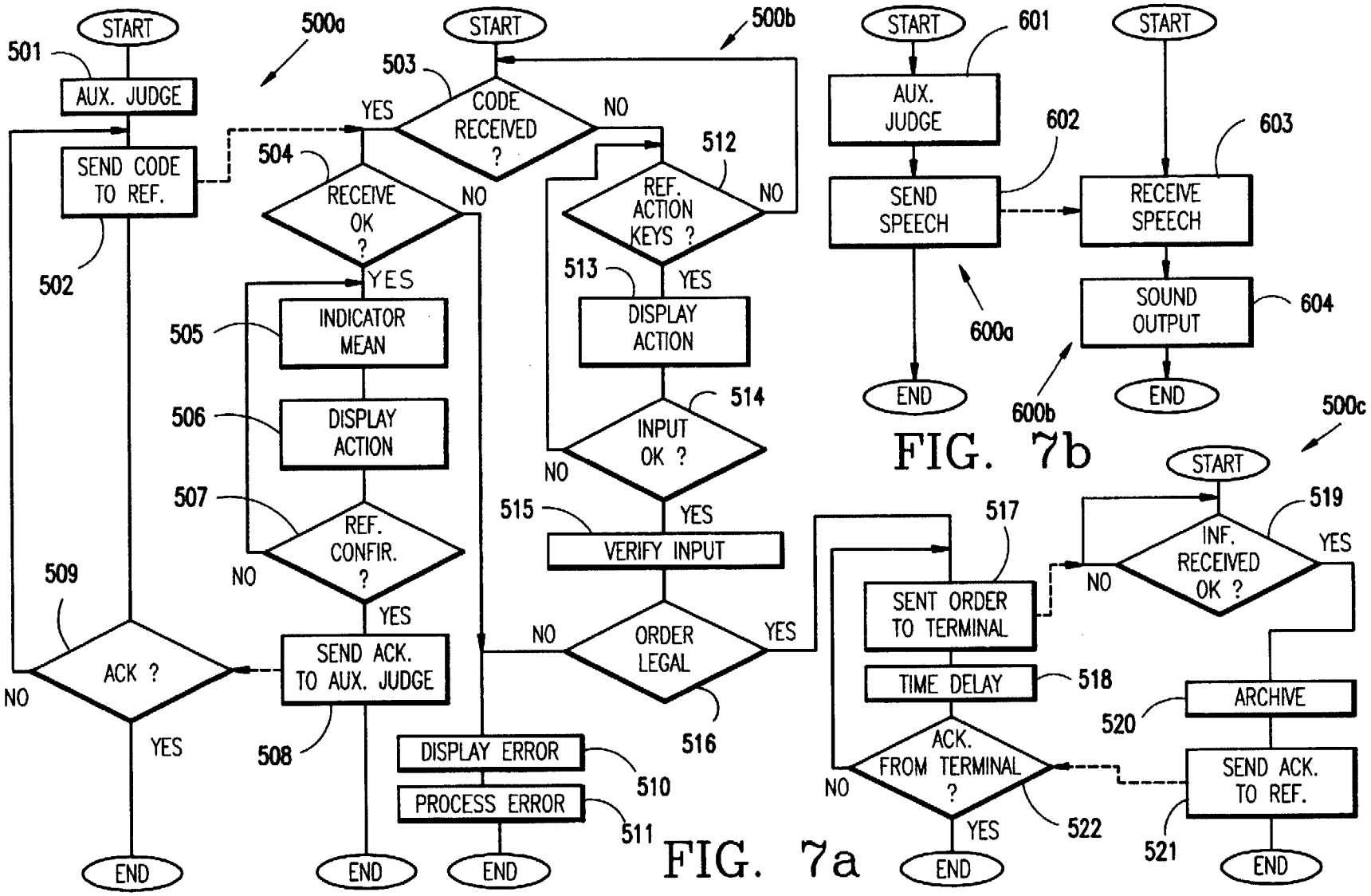
FIGS. 7*a* and 7*b* are flow charts explaining the operation of the refereeing system of the invention.

FIG. 7*b* relates more specifically to the operation of the voice link between the auxiliary judge and the referee. After the second switch 23 has been activated at step 601, the comments from the auxiliary judge are transmitted in step 602 to the referee's receiver which receives them in step 603 and applies them to the loudspeaker in step 604 to enable them to be heard.

It should be observed that this link can be activated at any time and therefore not necessarily during a critical stage of the game.

These exchanges of data between the various elements of the refereeing aid system of the invention make it possible in real time to manage the information being conveyed and, at the end of the match, an instant analysis of the information can be sent via the modem to any party concerned. Extracts from the information can thus be quickly provided to the press for broadcasting.

For example, in the event of an injury, data of interest to the appropriate social security organizations can also be updated quickly. The type of injury can be stored in the management terminal using the touch-sensitive screen 32 which may, for example, include a human outline, parts of which are made touch-sensitive so as to enable the nature of the injury to be input quickly.

The screen also performs a conventional graphics display console function so it may be simpler to provide the touch-sensitive screen function on a smaller screen that is dedicated to the function of inputting injuries.

The system created in this way makes it possible, in particular, to reduce errors due to human shortcomings and, because of the checking performed by the management terminal at the beginning of match, to avoid many kinds of fraud that can be tempting, e.g. when a member of a football team is absent. It may also be observed that the referee module may include a stopwatch function that issues an alarm to indicate the end of normal time, thereby preventing any time overruns that can give rise to disputes, particularly if the score is changed during the time overrun.

I claim:

1. A refereeing aid system for ball games played on a playing field, in which refereeing is performed by a referee in charge together with at least one auxiliary judge, both present on the playing field, the system including transmitter means carried by the auxiliary judges for selectively sending call signals to the referee, and communication means comprising receiver means carried by the referee for receiving said signals and providing an audible indication thereof, wherein said communication means further comprises transmitter means carried by the referee, enabling refereeing data previously input via input means to be communicated to management means disposed in the vicinity of the playing field and connected to computer means centralizing said refereeing data from a plurality of management means present at distinct playing fields, wherein the transmitter means made available to the auxiliary judges include respective coding circuits enabling the referee to identify the originator of a call signal emitted by the transmitter means by coding the call signal, wherein the call signal coding depends on a state of a switch and wherein the switch is operated automatically by the auxiliary judge holding up a flag in a vertical position.

2. A refereeing aid system according to claim 1, further comprising means for enabling the auxiliary judge to manually control the switch.

3. A refereeing aid system according to claim 1, wherein the switch is constituted by a mercury switch.

4. A refereeing aid system according to claim 1, wherein the management means comprise computer means, input means, display means, and transmitter/receiver means.

5. A refereeing aid system according to claim 4, wherein the management means further include confidential data input means for receiving personal data relating to each participant in the game.

6. A refereeing aid system according to claim 4, wherein the management means further include printer means for issuing, at the end of a match, information relating to actions undertaken on the playing field.

7. A refereeing aid system according to claim 4, wherein the display means are constituted by a touch-sensitive screen.

8. A refereeing aid system according to claim 1, wherein communication between the communication means and firstly the transmitter means and secondly the management means are implemented via radio links.

9. A refereeing aid system according to claim 1, wherein the means made available to the referee include computer means that perform a stopwatch function.

10. A refereeing aid system for ball games played in a playing field, in which refereeing is performed by a referee in charge together with at least one auxiliary judge, both present on the playing field, the system including transmitter means carried by the auxiliary judges for selectively sending call signals to the referee, and receiver means carried by the referee for receiving said signals and providing an audible indication thereof, wherein the transmitter means made available to the auxiliary judges include voice transmission means for enabling a voice link with the referee, wherein the receiver means made available to the referee include voice receiver means, wherein the transmitter means made available to the auxiliary judges include respective coding circuits enabling the referee to identify the originator of a call signal emitted by the transmitter means by coding the call signal, wherein the call signal coding depends on a state of a switch and wherein the switch is operated automatically by the auxiliary judge holding up a flag in a vertical position.

11. A refereeing aid system according to claim 10, wherein the switch is constituted by a mercury switch.

12. A refereeing aid system according to claim 1, wherein the input means made available to the referee include a first set of keys comprising alphanumeric keys for inputting coordinates of the participants, a second set of keys comprising symbol keys for inputting parameters specific to the game in question, a third set of keys comprising function keys and including an "enter" key for confirming preceding inputs, and a set of indicator means for verifying operations performed and for giving information to the referee.

* * * * *